US005740574A

United States Patent [19]

Piraino

[11] Patent Number: 5,740,574

[45] Date of Patent: Apr. 21, 1998

[54] HYBRID MATTRESS HAVING PORTIONS WITH DIFFERENT SUPPORT CHARACTERISTICS

[76] Inventor: Mario Piraino, 5 Nolan Close, East Doncaster, Victoria 3109, Australia

[21] Appl. No.: 767,226

[22] Filed: Dec. 13, 1996

[30] Foreign Application Priority Data

Dec. 13, 1995 [AU] Australia ..... 75321/96

[51] Int. Cl.[6] ..... A47C 27/05; A47C 27/00

[52] U.S. Cl. ..... 5/727; 5/716; 5/740

[58] Field of Search ..... 5/727, 716, 720, 5/738, 740

[56] References Cited

U.S. PATENT DOCUMENTS

| | | | |
|---|---|---|---|
| 2,629,111 | 2/1953 | Korney | 5/727 |
| 2,651,788 | 9/1953 | Forwood | 5/727 |
| 4,004,305 | 1/1977 | Rubin | 5/727 |
| 4,042,988 | 8/1977 | Holliday | 5/738 |
| 4,213,214 | 7/1980 | Gilhooly | 5/727 |
| 4,965,901 | 10/1990 | Mormand | 5/738 |
| 4,969,223 | 11/1990 | Yamaguchi | 5/738 |
| 5,533,218 | 7/1996 | Fahy | 5/727 |

FOREIGN PATENT DOCUMENTS

| | | |
|---|---|---|
| 221200 | 9/1957 | Australia . |
| WO 95/21048 | 8/1995 | WIPO . |

*Primary Examiner*—Alexander Grosz
*Attorney, Agent, or Firm*—Walter C. Farley

[57] ABSTRACT

A hybrid mattress has two or more individual support structures such as springs and a unitary comfort casing. The comfort casing is formed with two or more internal pouches each adapted to snugly receive one of the individual support structures and to hold the support structures in a planar, contiguous manner. The individual support means can be selected to have different load bearing characteristics from each other, thereby providing a continuous mattress with different support and comfort capabilities for different occupants.

3 Claims, 6 Drawing Sheets

HYBRID MATTRESS HAVING PORTIONS WITH DIFFERENT SUPPORT CHARACTERISTICS

INTRODUCTION TO INVENTION

This invention relates to bedding mattresses and in particular to a dual occupant mattress adapted to accommodate two people and having a hybrid construction to accommodate to the profile of each occupant.

BACKGROUND OF INVENTION

A bed is designed for the primary purpose of providing even support over the whole length of an occupant's recumbent body so as to minimize local pressure points between the occupant's body and the mattress and thereby evenly support the whole weight of the occupant body to ensure the greatest measure of comfort and support while maintaining a good posture during sleep.

To this end, beds generally comprise three main functional components:

1. A comfort means, being a superficial layer of padding with which the body has direct contact.
2. A support means, being a compliant structure to support the weight of the body.
3. A foundation means, being a construction for transferring the weight from the support means to the floor.

The comfort and support means are generally integrated into a device termed a mattress comprising a layer of inner springs covered by a foam or cloth padding; although numerous alternative devices, like futons, also comprise analogous systems and will be termed mattresses for the purposes of this application.

The comfort means may comprise a foam layer with optional layers of further padding such as wool or dacron and an outer protective cloth in any degree of hardness from very soft to very hard. The comfort means is adapted for encasement of the support means and has a primary function of providing a measure of padding to cushion the support means, which may be essential in the case of an inner spring mattress, or alternatively, as a way of providing a soft layer over the top of a firm support means such as solid foam, rubber, water or the like. In addition, the comfort means provides a method of encasing or holding together the support means and may, depending on the choice of padding, also contribute to the support provided by the support means.

The support means may comprise a set of springs, rubber and/or foam block, rolled cotton, compressed air, water or virtually any arrangement which provides a compliant structure of suitable thickness to absorb the body's contour.

The support means of a mattress is central in providing even and well distributed support for the entire body weight and contour irrespective of the degree of hardness provided by the comfort means encasing the support means.

In the case of an inner spring mattress, the compliance of the support means is provided by a linear array of steel compression springs held together by a series of edge and helical wires. The array of springs forms a compliant sheet adapted to conform to the contour of the occupant's body. The choice of spring length and gauge is crucial to ensure that the amount of deflection allowed by the support means is commensurate with the weight and contour of the occupant's body. If insufficient deflection is provided, part of the occupant's body will be undersupported and part will be oversupported leading to pressure points and lack of comfort. On the otherhand, if too much deflection is provided by the support means, the occupant's body will sink into the overall support means and be distorted usually resulting in undesirable curvature of the spine. In a worst case scenario, a large occupant could "bottom out" if the support means is too soft and deflects by 100%. Support means deflection of less than 70% is desirable in order to provide sufficient support for a given occupant.

The comfort means encases the support means and provides physical and thermal insulation as well as allowing an additional variable to be incorporated into a mattress. The comfort means can be a thin and hard cover or a softer and thicker cover. The type of comfort means will be chosen by preference of the occupant rather than a quantifiable measurement based on body weight and contour; although the choice of comfort means can contribute to the deflection measure of a given support means and should be taken into account when the measurements are taken to calculate the optimum support means.

Accordingly, a careful calculation and assessment of the individual characteristics of the occupants of a mattress are vital to ensure that each occupant obtains a satisfactory choice of mattress.

SUMMARY OF THE INVENTION

This invention is concerned with the combined comfort and support means as provided in a mattress and in particular with the problems of providing a single mattress for occupation by two people of differing body heights, weights and contours. Traditionally a mattress has been chosen based on a compromise between both occupants and more often than not neither occupant ends up with a satisfactory mattress. Furthermore, when a single construction mattress is chosen which has inadequate support or which allows too much deflection the movement of one occupant can disturb the second occupant and can also sometimes result in the two occupants merging together in a common valley, known as roll-together.

In order to address such a problem some attempts have been made to provide hybrid mattresses comprising two individual mattresses joined together. However due to manufacturing difficulties, costs and other factors a satisfactory hybrid mattress has not been made available.

The systems used to date generally involve the literal joining together of two independent mattress units by zips or tags to provide such a hybrid. Of course, such efforts result in cumbersome mattresses which are difficult to install, move and most importantly, suffer from severe interface problems where the two mattresses join together.

An object of this invention is to provide an improved mattress.

Accordingly, the invention provides in one aspect, a hybrid mattress comprising two or more individual support means (as hereinbefore defined) and a unitary comfort means (as hereinbefore defined) wherein the comfort means, has two or more internal pouches each adapted to snugly receive one of each said individual support means and further adapted to juxtapose each said individual support means in a planer and contiguous manner to provide a continuous mattress having two or more distinct load bearing characteristics.

The comfort means may be constructed of foam rubber having a continuous top surface member, a continuous bottom surface member, edge members and an internal separate member adapted to delineate and interface said internal pouches.

The interface member may be integral with said top and bottom surface members and constructed of foam having a deflection co-efficient being about the mean value of the deflection co-efficients of said individual support means.

The support means is preferably a plurality of compression springs.

BRIEF DESCRIPTION OF THE DRAWINGS

The invention will now be described in greater detail by reference to the following drawings of particularly preferred embodiments where.

DESCRIPTION OF THE PREFERRED EMBODIMENTS

Figure 1:
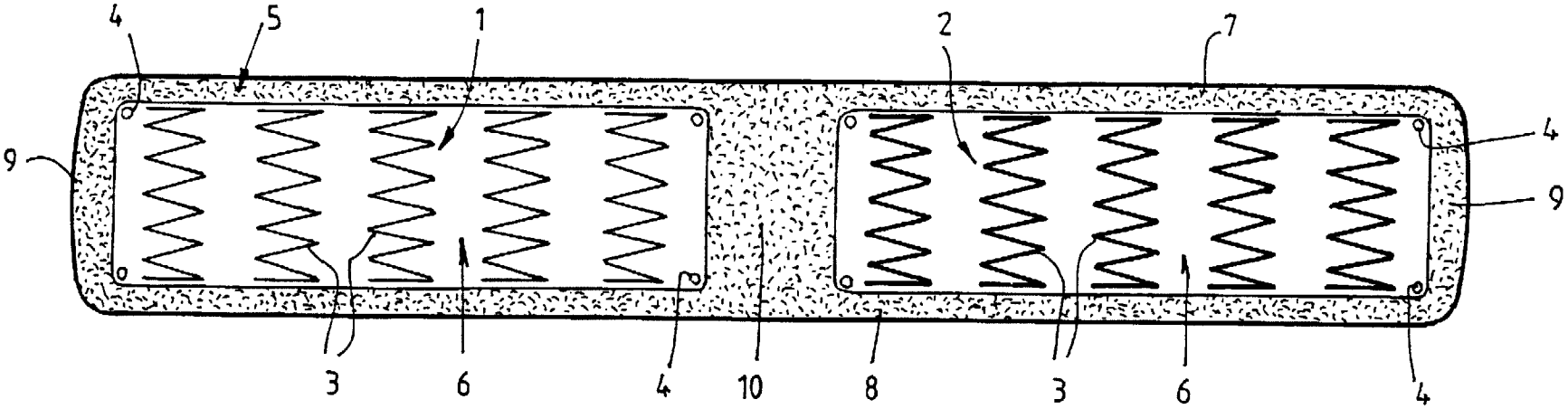
FIG. 1. PRIOR ART
FIG. 1 shows an end cross-section through a hybrid mattress of the invention.

Referring firstly to FIG. 1, the hybrid mattress of the invention comprises two individual support means 1 and 2 being separate inner spring supports having differential deflection co-efficients. The support means 1 has light weight springs adapted to provide a maximum deflection of about 70% for a 55 kg occupant. The support means 2 has heavy weight springs adapted to provide a maximum deflection of about 70% for a 90 kg occupant. The individual compression springs 3 are held together in the usual manner by edge wires 4 with the adjoining springs laced together as appropriate. The perimeter edge wire 4 is fitted to the top and bottom of the support means to strengthen and hold the mattress as a unit. Edge reinforcing springs 11 are fitted at "stiffened areas" of the support means (see FIG. 8) and may be optionally fitted along the perimeter of the mattress to strengthen the perimeter, particularly to accommodate occupants sitting on the perimeter of the mattress. The two individual support means are juxtaposed longitudinally side by side but without touching by the provision of a comfort means 5 which comprises a unitary casing piece of foam rubber having two pouches 6 sized to snugly receive the individual support means. The casing structure of the comfort means has a top surface member 7 which is a continuous layer of foam, a bottom surface member 8 which is a continuous layer of foam, edge members 9 along the perimeter and an internal interface member 10 which is a ridge of foam connecting the top and bottom surface members and creating the two pouches 6 into which the individual support means fit. The edge members 9 may incorporate air circulation vents to allow free movement of air through the mattress. The air circulation vents may be used as access points to allow the inside of the mattress to be treated with anti-bacterial or anti-parasitic formulations or the like.

Figure 2:
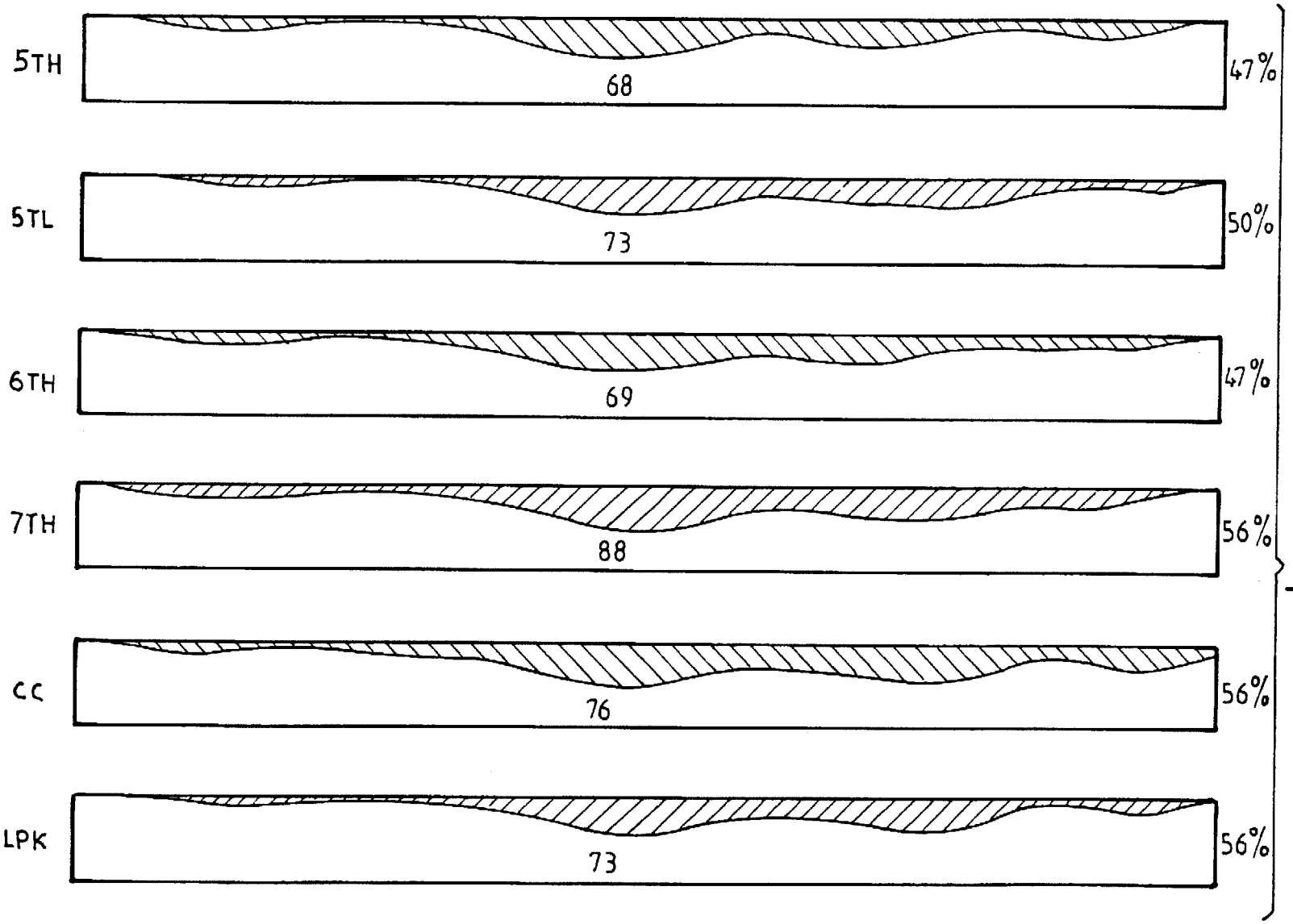
FIG. 2 shows the deflection or depression profile of a 55 kg occupant (on back) on a support unit.
Figure 3:
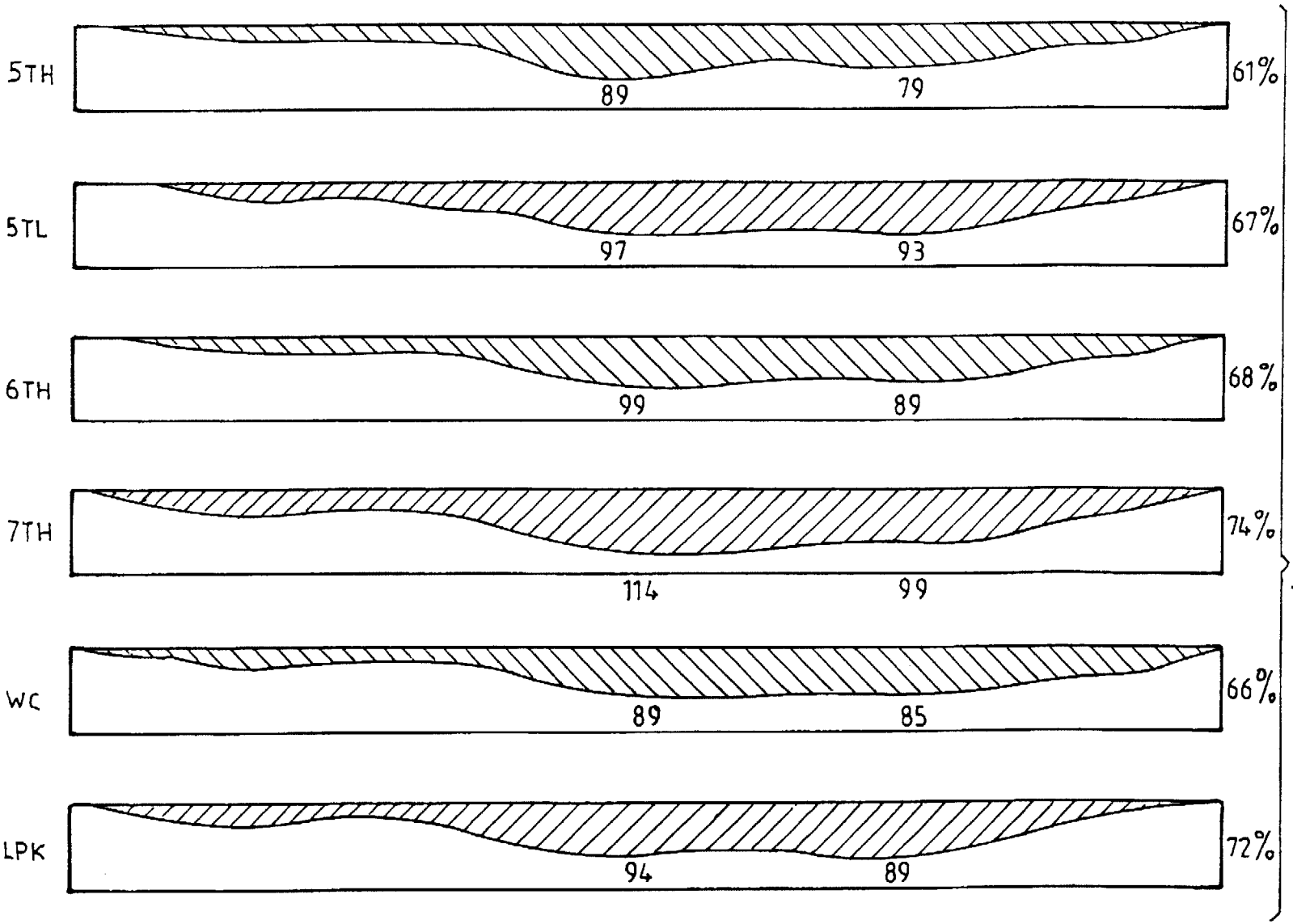
FIG. 3 shows the deflection or depression profile of a 93 kg occupant (on back) on a support unit.
Figure 4:
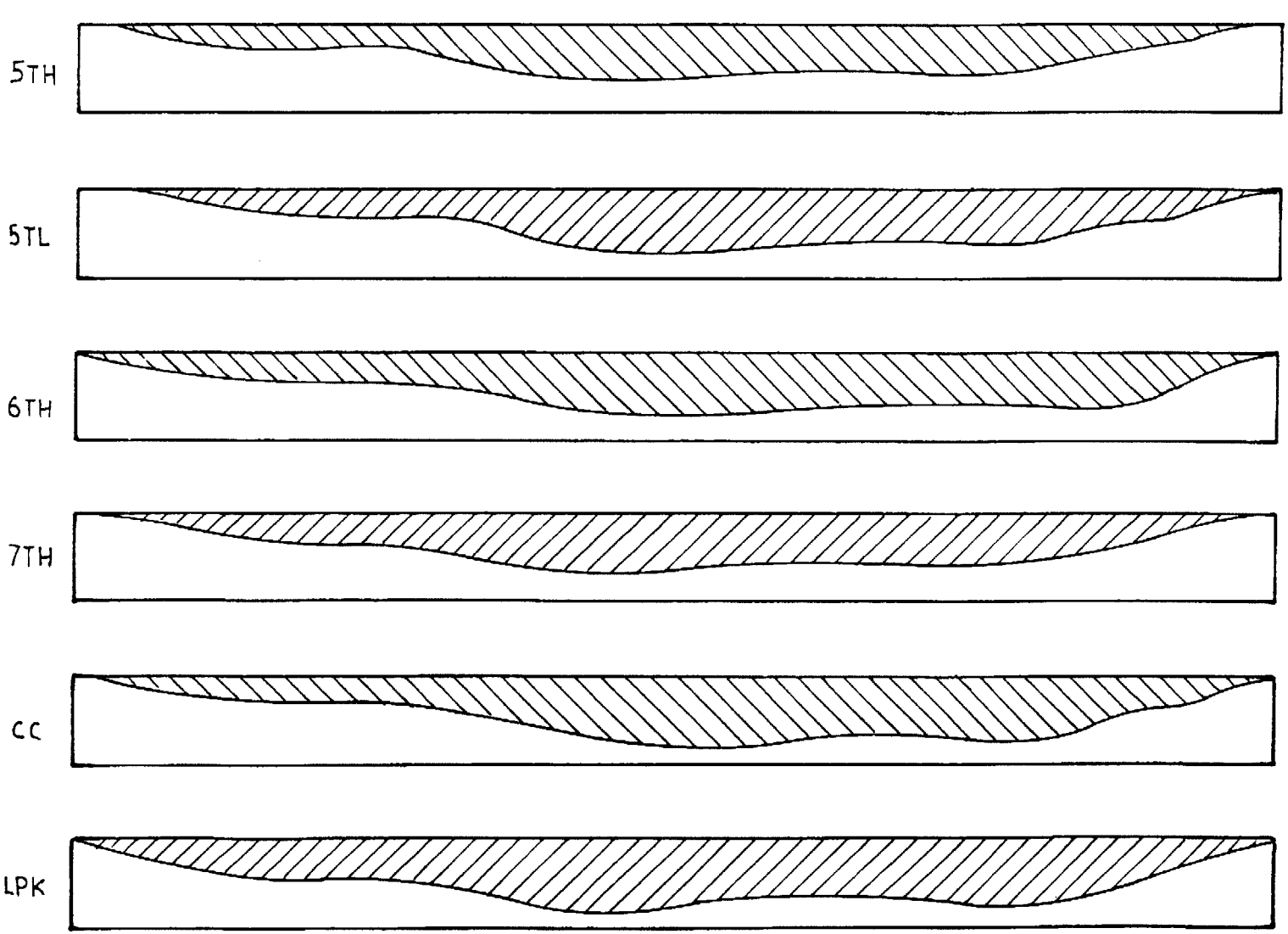
FIG. 4 shows the deflection or depression profile of a 93 kg occupant (on side) on a support unit.

FIGS. 2, 3 and 4 show the type of deflection gradients measured on a range of readily available support means products ranging from 5 turn heavy gauge spring 145 mm deep unit, 5 turn light gauge 145 mm, 6 turn heavy gauge 145 mm, 7 turn heavy gauge 155 mm, continuous coil 1350 mm, LFK spring 1300 mm.

FIG. 2 shows a 55 kg person lying on his or her back on the range of available products. The maximum depression is noted at the appropriate point.

The greater number of turns provided in a helical spring allow for greater deflection with a light gauge wire providing greater deflection than a heavy gauge wire. Accordingly, the 5 turn heavy gauge support provides the lowest level of deflection and hardest bed, whereas the 6 and 7 turn springs provide greatest level of deflection. In FIGS. 3 and 4, the 93 kg occupant can approach maximum deflection.

Figure 5:
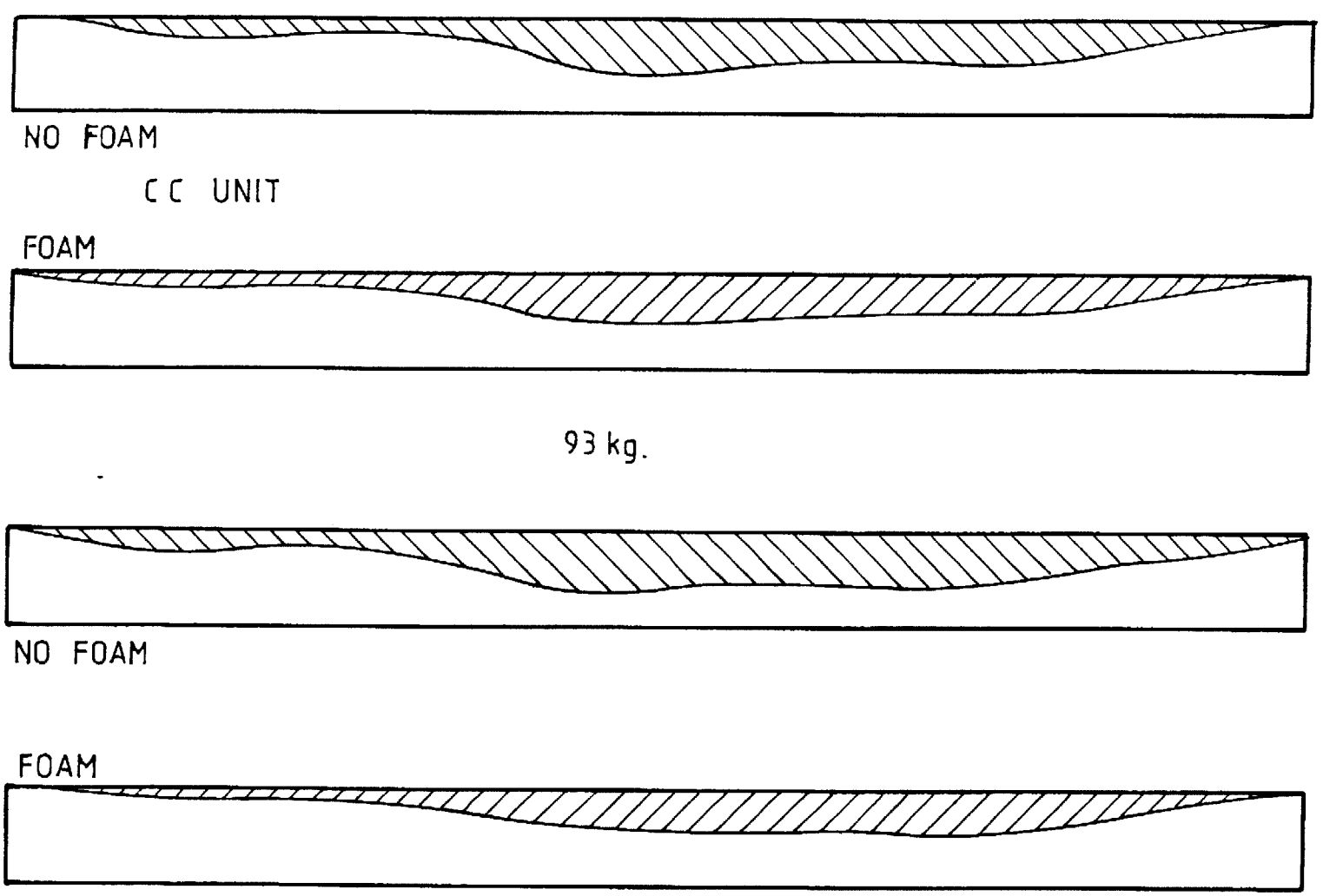
FIG. 5 shows the deflection or depression profile of a support unit with and without a comfort means.

FIG. 5 demonstrates the contribution the comfort means can make to the deflection co-efficient of a given support means such that in order to provide an accurate deflection profile for an occupant, it is desirable to consider the chosen comfort means in conjunction with the support means to arrive at the optimal deflection result for each occupant.

In practice, two prospective occupants would be asked to select from a range of comfort means ranging from hard to soft depending on preference. If both occupants choose the same grading of comfort means then a single grade can be used to construct the unitary comfort means. However, if the occupants decide on different grades or hardness of the comfort means, the different grades can be incorporated into the top surface member while maintaining the unitary feature of the comfort means. More particularly, in such a situation the top and bottom surface members could be constructed of two separate pieces which are welded together at the interface member to ensure a final unitary structure to the comfort means. An average contribution to the deflection coefficient of 15% can be allowed for the comfort means. Given the choice of comfort means each occupant would be measured for deflection co-efficient of no greater than 70% for the support means providing a total combined deflection co-efficient of no more than 55%, taking into account the chosen comfort means. The two individual measurements would be tailored to conform, as near as practicable, to record the same deflection measure. In the case of two occupants of similar build, only small variations may be required. In the case of two occupants of great difference, a wide variation in support means would be required. The two dedicated support means are then inserted into the pockets on either side of the comfort means. The comfort means may be manufactured as a single foam rubber item or assembled by welding together the components.

Figure 8:
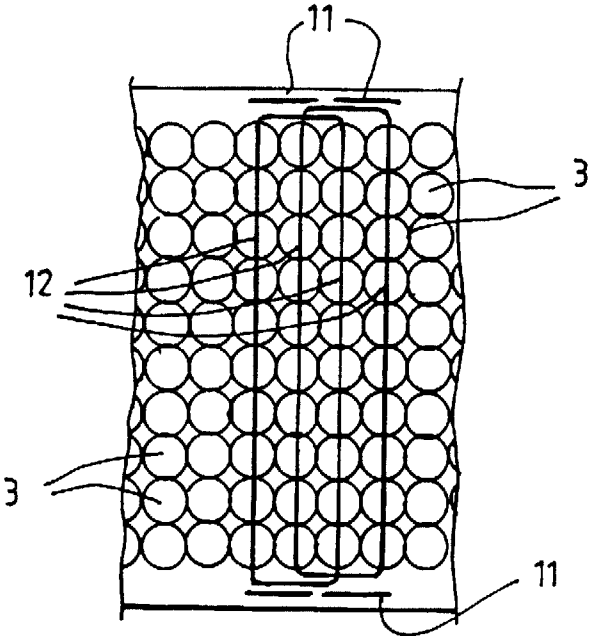
FIG. 8 shows a plan view of the support unit incorporating a stiffening means.

Once the hybrid mattress is assembled, it is provided to its customers as a dedicated and tailor built unit which is adapted to cater to different occupants in a single mattress unit. As an additional feature, the mattress of the invention may be provided with an auxiliary local stiffening means as shown in FIG. 8. In the case heavy occupants of 90 kg or above, as shown in FIG. 3, the normal compliance of the support unit may be "used up" resulting in the spinal region of the occupant flattening out with a loss of lordosis. Such a situation can be accommodated by fitting a dedicated stiffening means to the mattress. The stiffening means may comprise edge support spring 11 and a series of lateral wires 12 positioned across the mattress and connected to the individual compression springs 3 to form a band of particularly firm support in the region of the small of the back of the occupant to encourage the forming of the natural lordosis of the spine during sleeping.

Figure 6:
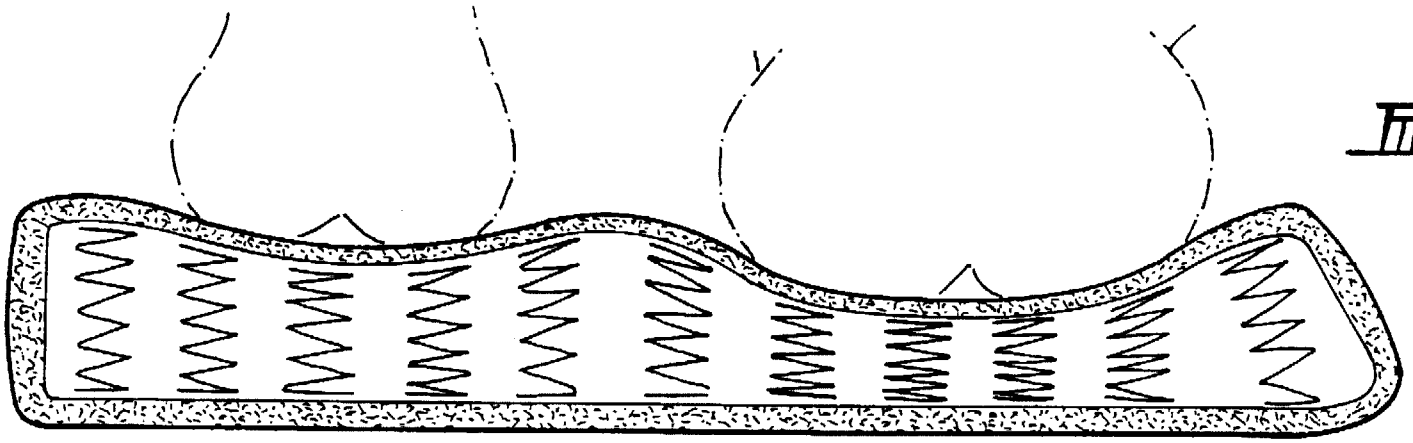
FIG. 6 shows a standard unitary mattress under load from two occupants having differing weights.
Figure 7:
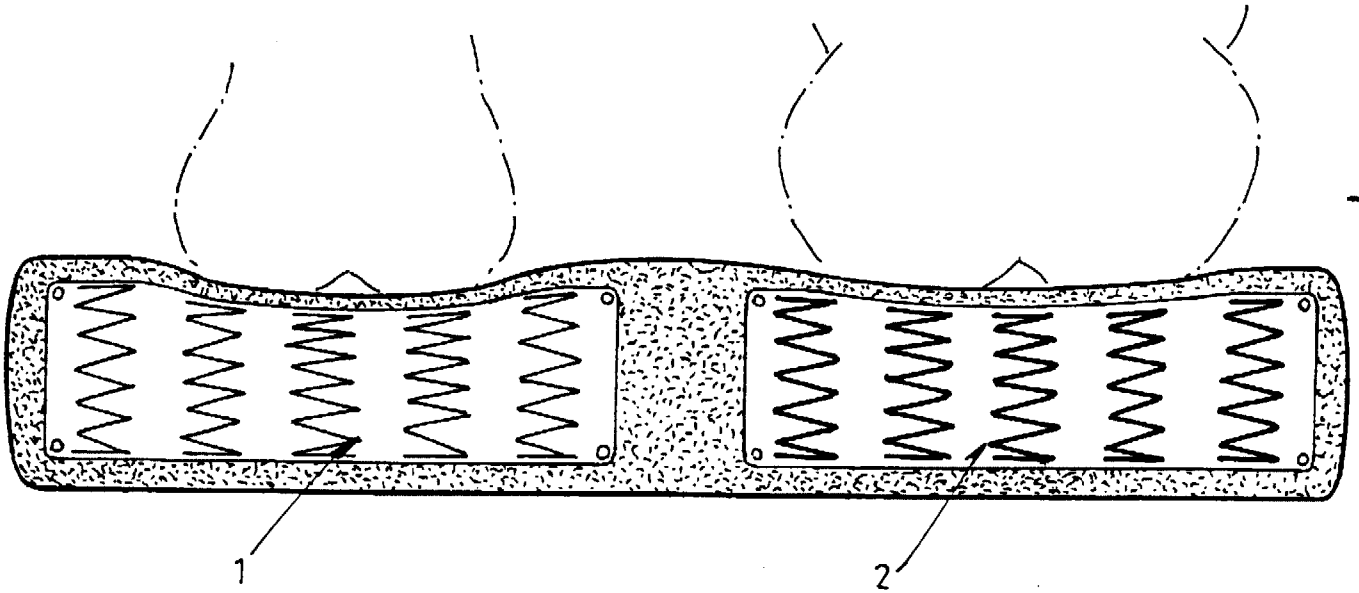
FIG. 7 shows the hybrid mattress under load from two differing in weight.

In use, FIGS. 6 and 7 contrast the effect of two different people occupying a unitary mattress of uniform deflection rating where the heavier occupant clearly causes more deflection than the lighter occupant, resulting in distortion to the mattress and tending to generate roll-in. FIG. 7 shows the performance of the hybrid mattress of the invention where the deflection of both occupants has been matched in the one mattress minimising roll-in and insuring maximum comfort and support for both occupants.

The embodiment of the invention is not confined to coil spring mattresses but may also include hybrids of spring/futon; spring/water; spring/foam or any combination of mattress that is desired.

The action of the interface member serves to alleviate the problems of the prior art by way of traversing the change in support rating from one unit to the other. In addition, the unitary comfort means allows the hybrid mattress to act as a single unit without coming apart or shifting during use.

Of course, numerous variations of the mattress are incorporated in the scope of the invention and are not limited to the embodiments detailed.

The claims defining the invention are as follows:

1. A hybrid mattress comprising a plurality of individual, resilient support means (1, 2) for supporting a recumbent human body, each of said support means having an upper body support surface, a lower support surface and peripheral edges, said support means having different deflection coefficients;

comfort means comprising a casing structure (5) comprising a plurality of internal pouches, equal in number to the number of support means, each said pouch being dimensioned to snugly receive one of said support means, one of said support means in each said pouch, a continuous top surface member (7), a continuous bottom surface member (8), an edge member (9) and an internal interface member (10) forming a barrier between said pouches, said interface member (10) being formed integrally with said top and bottom surface members, said interface member having a deflection coefficient substantially equal to a mean value of deflection coefficients of said individual support means; and said pouches being aligned with each other so as to hold said plurality of support means with said upper body support surfaces in substantially a single plane, thereby forming a continuous mattress having two or more distinct load bearing characteristics.

2. A mattress according to claim 1 wherein each of said support means comprises a plurality of compression springs and said comfort means comprises foam rubber.

3. A mattress according to claim 2 wherein said individual support means have different load bearing characteristics from each other.

* * * * *